US007326169B2

(12) United States Patent
Brüning et al.

(10) Patent No.: US 7,326,169 B2
(45) Date of Patent: Feb. 5, 2008

(54) FULL-JACKET HELIX CENTRIFUGE WITH A WEIR

(75) Inventors: Paul Brüning, Oelde (DE); Jürgen Hermeler, Haltern (DE); Helmut Figgener, Oelde (DE)

(73) Assignee: Westfalia Separator AG, Oelde (DE)

( * ) Notice: Subject to any disclaimer, the term of this patent is extended or adjusted under 35 U.S.C. 154(b) by 286 days.

(21) Appl. No.: 10/502,788

(22) PCT Filed: Jan. 27, 2003

(86) PCT No.: PCT/EP03/00776

§ 371 (c)(1),
(2), (4) Date: Mar. 15, 2005

(87) PCT Pub. No.: WO03/064054

PCT Pub. Date: Aug. 7, 2003

(65) Prior Publication Data

US 2005/0164861 A1 Jul. 28, 2005

(30) Foreign Application Priority Data

Jan. 30, 2002 (DE) ..... 102 03 652

(51) Int. Cl.
*B04B 11/02* (2006.01)
*B04B 1/20* (2006.01)

(52) U.S. Cl. ..... 494/56; 494/53

(58) Field of Classification Search ..... 494/53–54, 494/56–57; 210/380.1, 380.3
See application file for complete search history.

(56) References Cited

U.S. PATENT DOCUMENTS

| | | | | | |
|---|---|---|---|---|---|
| 3,580,492 | A | * | 5/1971 | Schnittger et al. | 494/53 |
| 3,858,794 | A | * | 1/1975 | Nilson et al. | 494/4 |
| 4,190,194 | A | * | 2/1980 | Amero | 494/27 |
| 4,575,370 | A | * | 3/1986 | LaMontagne | 494/56 |
| 4,615,690 | A | * | 10/1986 | Ecker | 494/56 |
| 4,761,157 | A | * | 8/1988 | Shapiro | 494/35 |
| 4,764,163 | A | * | 8/1988 | Caldwell | 494/56 |
| 4,950,219 | A | * | 8/1990 | Luchetta | 494/53 |
| 5,169,377 | A | * | 12/1992 | Schlip et al. | 494/56 |
| 5,171,205 | A | * | 12/1992 | Monkenbusch | 494/10 |
| 5,217,428 | A | * | 6/1993 | Schlip et al. | 494/56 |
| 5,257,968 | A | * | 11/1993 | Caldwell | 494/53 |
| 5,259,828 | A | * | 11/1993 | Schlieperskoetter | 494/38 |
| 5,593,377 | A | * | 1/1997 | Figgener et al. | 494/56 |
| 5,618,409 | A | * | 4/1997 | Kreill | 210/97 |

(Continued)

FOREIGN PATENT DOCUMENTS

| | | | |
|---|---|---|---|
| DE | 36 20 912 | A1 | 12/1987 |
| DE | 3822983 | A1 * | 1/1990 |
| DE | 39 04 151 | A1 | 8/1990 |
| DE | 41 30 759 | A1 | 3/1993 |
| DE | 41 32 029 | A1 | 4/1993 |
| DE | 43 20 265 | A1 | 12/1994 |
| DE | 19962645 | A1 * | 7/2001 |
| DE | 100 21 983 | A1 | 11/2001 |
| DE | 10021642 | A1 * | 11/2001 |

(Continued)

OTHER PUBLICATIONS

Patent Abstracts of Japan, "Device Of Discharging Separated Water From Horizontal Centrifuge", Publication No. 11179236, Jul. 6, 1999.

*Primary Examiner*—Charles E. Cooley
(74) *Attorney, Agent, or Firm*—Barnes & Thornburg LLP

(57) ABSTRACT

A full-jacket helix-type centrifuge including a drum and at least one weir having a port. A throttle disk is assigned to the port. At least one nozzle rotates with the drum and is assigned to an outlet for discharging clarified liquid from the drum.

21 Claims, 3 Drawing Sheets

U.S. PATENT DOCUMENTS

| | | | | | |
|---|---|---|---|---|---|
| 5,653,674 | A * | 8/1997 | Leung | 494/53 |
| 5,885,202 | A * | 3/1999 | Ostkamp | 494/25 |
| 5,913,767 | A * | 6/1999 | Feldkamp et al. | 494/4 |
| 6,290,636 | B1 * | 9/2001 | Hiller et al. | 494/53 |
| 7,022,061 | B2 * | 4/2006 | Leung et al. | 494/56 |
| 7,083,565 | B2 * | 8/2006 | Hermeler et al. | 494/53 |
| 2004/0058796 | A1 * | 3/2004 | Feldkamp et al. | 494/56 |
| 2004/0072667 | A1 * | 4/2004 | Leung et al. | 494/56 |
| 2004/0072668 | A1 * | 4/2004 | Leung | 494/56 |
| 2005/0164861 | A1 * | 7/2005 | Bruning et al. | 494/56 |
| 2006/0142137 | A1 * | 6/2006 | Hermeler et al. | 494/53 |

FOREIGN PATENT DOCUMENTS

| | | | |
|---|---|---|---|
| EP | 0186761 | A2 * | 11/1985 |
| EP | 0447742 | A2 * | 9/1991 |
| EP | 1588769 | A1 * | 10/2005 |
| FR | 2120537 | * | 8/1972 |
| JP | 11-179236 | * | 7/1999 |
| JP | 11-197547 | * | 7/1999 |
| WO | 03/064054 | A1 * | 8/2003 |
| WO | 03/074185 | A1 * | 9/2003 |
| WO | 2005/097336 | A1 * | 10/2005 |

* cited by examiner

V' := VOLUME FLOW s := GAP WIDTH BETWEEN THROTTLE DISK AND DRUM WEIR

V' := VOLUME FLOW t := POOL DEPTH IN THE DECANTER DRUM

FULL-JACKET HELIX CENTRIFUGE WITH A WEIR

BACKGROUND AND SUMMARY

The present disclosure relates to a full-jacket helix-type centrifuge.

Such a centrifuge is known from German Patent Document DE 43 20 265 A1. The full-jacket helix-type centrifuge disclosed in that document is provided with a weir on the fluid outlet side, which weir has a port which may be formed by several grooves originating from the inside diameter of the weir or by openings provided in the walls of the weir. A throttle disk, which stands still relative to the drum during the rotation of the drum and can be axially displaced by way of a threaded bush, is assigned to the port.

The distance between the weir and the throttle disk can be changed by the rotation of the threaded bush. As a result, the discharge cross-section changes for the fluid discharging from the centrifugal drum, which discharge cross-section is composed of the overall length of the overflow edge of the port and the distance between the weir and the throttle disk.

The change of the discharge cross-section causes a change of the fluid level in the centrifugal drum, so that a continuous adjustment of this liquid level becomes possible by displacing the throttle disk.

The displacing of the throttle disk in the axial direction can also be implemented in that the throttle disk is linked on its outer circumference and is swivelled, which virtually causes an axial displacement between throttle disk and the weir in the area of the weir.

The publication "Patent Abstracts of Japan", Number 11179236 A shows that baffle plates can be assigned to a port, which provide the fluid discharging from the drum with a swirl, whereby the occurring recoil effect is to be utilized for saving energy.

The construction according to German Patent Document DE 43 20 265 A1 has been successful per se since it offers a solution to the problem occurring in the case of the construction in German Patent Document DE 41 32 029 A1 which is that the devices for adjusting the overflow diameter on the weir rotate along with the drum during the operation, which requires a relatively high-expenditure and cumbersome transfer of actuating forces to the rotating centrifugal drum.

It is nevertheless desirable to create an additional adjusting possibility of the weir of the full-jacket helix-type centrifuge to variable inflow capacities for different usage purposes by simple devices. The present disclosure addresses this possibility.

SUMMARY

The present disclosure relates to a full-jacket helix-type centrifuge that includes a drum and at least one weir having a port. A throttle disk is assigned to the port, and the throttle disk is located at a variable distance from the port. The at least one nozzle rotates with the drum, and the at least one nozzle is assigned to an outlet for discharging clarified liquid from the drum.

Accordingly, at least one or more nozzles rotate along with the drum and are assigned to the port for the discharge or diversion of the clarified fluid.

In this manner, the centrifuge permits the diverting of a basic quantity of liquid from the drum through the nozzles, which quantity is fixed during an operation of the centrifuge. A precise regulating or precise adjusting of the liquid level in the full-jacket centrifuge is possible by a variable throttling device, particularly the throttle disk.

Nozzles on full-jacket centrifuges and their effect with respect to saving power when correspondingly directed in an inclined manner relative to the drum axis are known per se, for example, from German Patent Document DE 39 004 151 A1. The present disclosure's combination of these nozzles with a throttling device at the liquid discharge is not known. The throttling device is used for regulating the fluid level in the centrifuge. An increasing flow resistance at the gap through which the fluid exits at the throttling device requires a higher fluid pressure at the port, which results in a rise of the fluid level in the centrifuge. Since, as a result of this pressure change, the amount of the fluid quantity flowing out through the nozzles also changes, these two effects add up; that is, the achievable control range becomes larger and the control characteristic is favorably influenced. This effect does not occur according to the state of the art, since no throttling device with nozzles connected on the input side is provided there, only nozzles with an overflow opening on the output side are provided. According to the state of the art, as a result of the nozzle, power will be saved and the conditions at the solids discharge will be improved.

The nozzles of the present disclosure may be constructed to be changeable in order to be able to carry out a preadjustment of the discharging fluid amount in a simple manner, for example, in the event of strongly varying amounts of throughput. Additionally, the exchange of the nozzles for other nozzles with a different diameter provides a simple additional possibility of changing the control characteristic and adjusting characteristic. "Nozzles" with blind holes (closed holes) can also be used, whereby the number of nozzles and the characteristic can also be changed.

In an embodiment, the nozzles are connected behind the port, and the throttling device, in turn, is connected behind the nozzles.

In an embodiment, the nozzle chamber also has a diameter which corresponds to the diameter the outer edge of the port. As a result, favorable flow conditions are ensured in the nozzle chamber which largely or completely prevent an accumulation of dirt. In that case, broaching elements are no longer required in the nozzle chamber.

In order to avoid clogging, the nozzles may have a diameter of more than 2 mm. In particular, the nozzles can be provided with such a large diameter if, relative to the lagging, they are arranged radially offset toward the interior such that, in a plane perpendicular to the drum axis, the nozzles have or are at a distance of from 25 to 75% of the drum radius from the outer drum radius. Their diameter can be selected to be the larger, the farther the nozzles are arranged toward the interior, in order to implement a consistent discharge output. The arrangement farther toward the interior basically allows the nozzles to be designed such that clogging is reliably avoided. This was not recognized in the state of the art. Also for this reason, those nozzles have not been significantly successful in practice.

Arranging the nozzles farther in the interior toward the axis of rotation makes it possible to change a ring chamber, as provided according to German Patent Document DE 43 20 265 A1 where it is called a ring duct. Therefore, the broaching tools provided and arranged there in the ring duct, which are necessary for avoiding the accumulation of dirt, can be eliminated.

In addition to the good adjustability and adaptability of the amount of the discharging fluid from the full-jacket helix-type centrifuge, the openings of the nozzles are directed correspondingly inclined with respect to the axis of symmetry or rotation of the drum. Thus, the fluid exiting from the nozzles reduces the driving power and energy of the full-jacket helix-type centrifuge to be applied. This saving of energy is not inconsiderable and can lead to a noticeable lowering of the power consumption of the full-jacket helix-type centrifuge.

Relative to the rotating direction of the drum, the openings of the nozzles are directed to the rear in order to save energy.

Relative to a tangent in a plane perpendicular to the axis of rotation on the drum surface, the openings of the nozzles are preferably directed such that they have an inclination of between 0° and 30°. An inclination of 0° results in a maximal gain of energy. Values larger than 0° and smaller than 30° can easily be implemented constructively.

If an embodiment with a radial alignment of the nozzle openings is implemented, a saving of energy during the actuating of the drum may be eliminated. However, the easy adaptability to different amounts passing through is maintained, so that such an embodiment offers a favorable comparison to the state of the art.

The gain of energy in the case of full-jacket helix-type centrifuges of the present disclosure is such that the circumferential speed of the drum at the outside diameter of the drum during the operation is more than 70 m/s because the gain of energy has a particularly clear effect in the case of such centrifuges.

These and other aspects of the present invention will become apparent from the following detailed description of the invention, when considered in conjunction with accompanying drawings.

DETAILED DESCRIPTION

Figure 2:
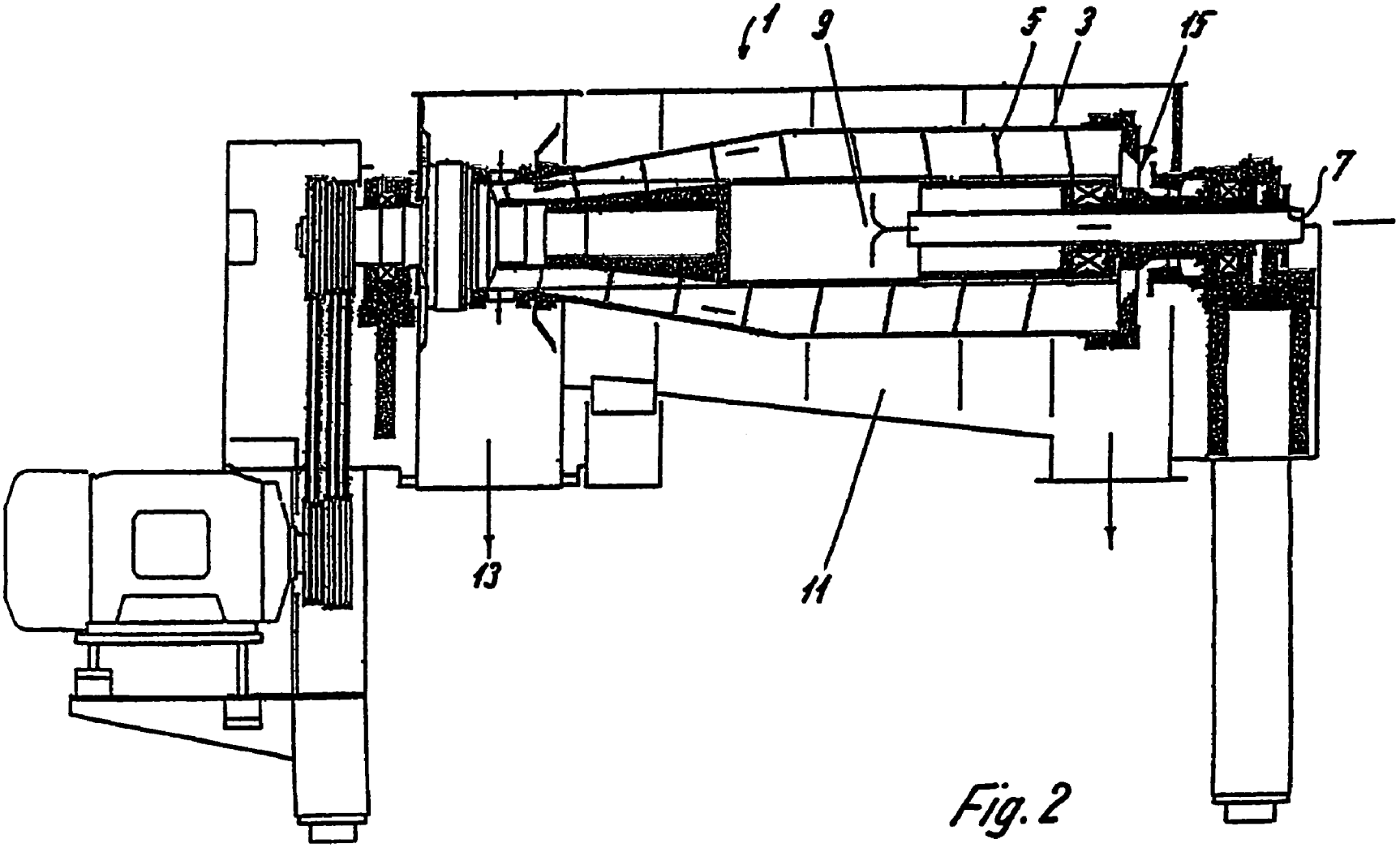
Fig. 2 PRIOR ART
FIG. 2 is a schematic view of a prior art full-jacket helix-type centrifuge with a weir further developed as an overflow.

FIG. 2 illustrates the basic construction of a known full-jacket helix-type centrifuge.

FIG. 2 shows a full-jacket helix-type centrifuge 1 having a drum 3 in which a helix 5 is arranged. The drum 3 and the helix 5 each have an essentially cylindrical section and a section which tapers conically.

An axially extending centric inflow tube 7 is used for feeding the material to be centrifuged by way of a distributor 9 into the centrifugal space 111 between the helix 5 and the drum 3.

If, for example, a sludgy mush is guided into the centrifuge 1, coarser solid particles are deposited on a drum wall. A fluid phase is formed farther toward an interior of the centrifuge 1.

The helix 5 rotates at a slightly lower or higher speed than the drum 3 and delivers centrifuged solids toward the conical section out of the drum 3 to a solids discharge 13. In contrast, the fluid phase flows to the larger drum diameter at the rearward end of the cylindrical section of the drum 3 and is diverted there through or by way of a weir 15.

Figure 1:
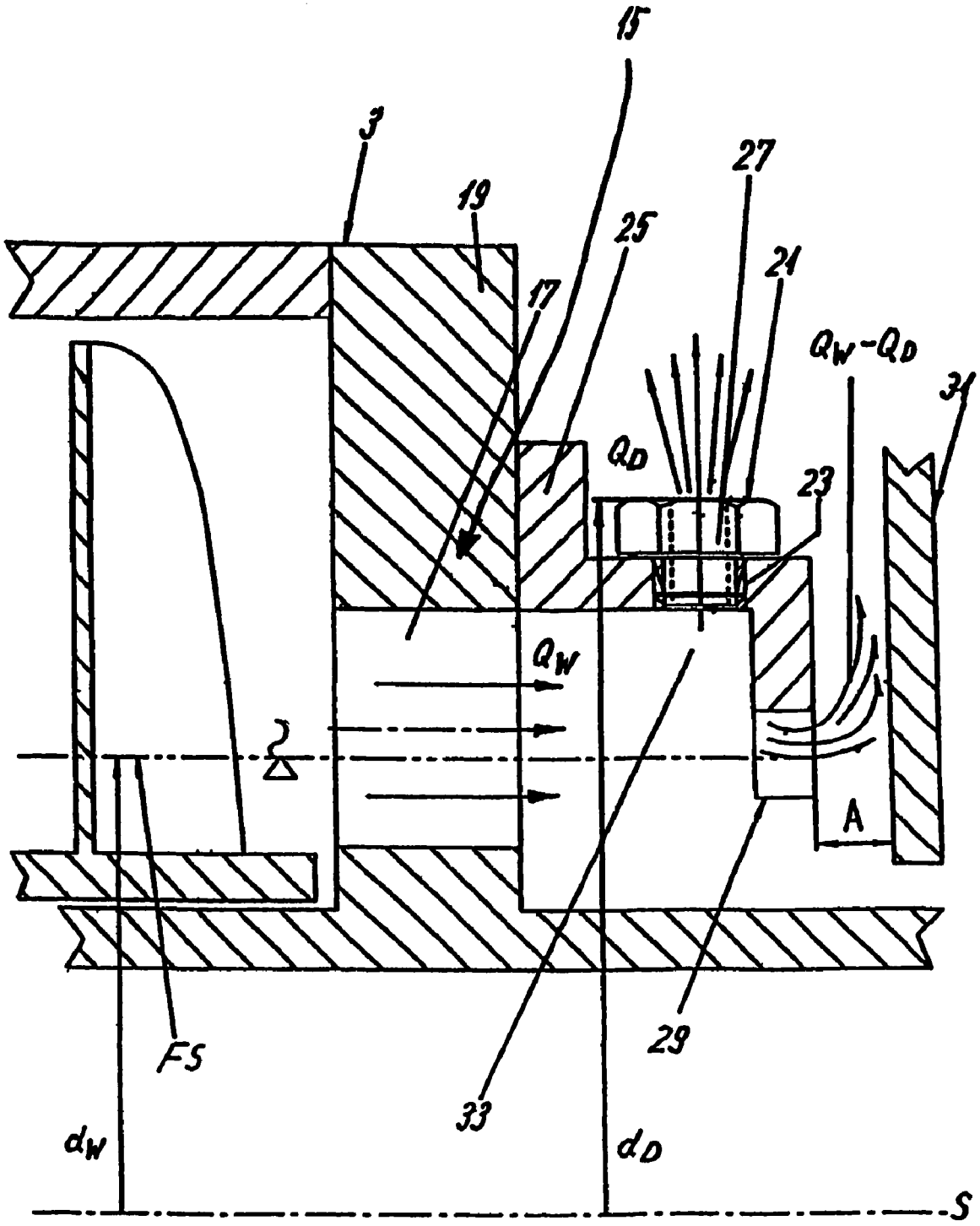
FIG. 1 is a cross-sectional view of an area of a weir of a full-jacket helix-type centrifuge, according to the present disclosure.

FIG. 1 shows a weir 15 further developed according to the present disclosure.

According to FIG. 1, the weir 15 has an overflow-type port 17 in an axial lid 19 of the drum 3. A combination of at least one or more nozzles 21, as well as an adjustable throttling device 31 shown, for example, as a throttle disk, is assigned or connected on an output side of the port 17.

The nozzles 21 are constructed as screwing bodies inserted into directed openings 23 of a stepped ring attachment 25. The openings 23 are further developed radially or inclined with respect to a drum axis S. Holes, bores or inlet openings 27 of the screwing bodies are aligned perpendicularly or at an angle with respect to the drum axis S of the drum 3.

In the area or section adjoining the port 17, the ring attachment 25 has an inside diameter which corresponds to an outside diameter of the port 17. A nozzle chamber 33 also has a diameter which corresponds to the diameter at the outer edge of the port 17. Also, the inlet openings 27 of the nozzles are situated flush with the diameter of the overflow-type port 17. This prevents the accumulation of dirt in the nozzle chamber 33.

At its end facing away from the port 17, the ring attachment 25 forms an axial outlet 29 on whose output side the throttle disk 31 is connected. A distance between the throttle disk 31 and the outlet 29 is variable, for example, in the manner described in German Patent Document DE 43 20 265 A1 by different actuating devices (not shown here).

The distance between the throttle disk 31 and the outlet 29 may be changed by an axial movement, for example, by an axial displacing or by a swivelling of the throttle disk 31, which stands still relative to the rotating drum 3. As an alternative, it is also conceivable that the throttle disk 31 rotates along with the drum 3 in the operation (not shown). However, the rotating alternative may require higher constructive expenditures than the embodiment in which the throttle disk 31 does not rotate along.

The term "nozzle" is to be understood such that the bore or inlet opening 27 may have a diameter which is constant or variable along an axial dimension of the opening 27. The nozzle 21 may also be constructed as a bore in the ring attachment 25; however, the screwing bodies offer changeability and preadjustment of a discharge quantity.

In the inner nozzle chamber 33, ribs (not shown here) may be included and may improve delivery of fluid.

Through the nozzles 21, a basic quantity of fluid may be preadjusted, depending on the design and diameter of the openings 27 of the changeable screwing bodies, and diverted from the drum 3. An optimal alignment of the nozzles 21 for a maximal saving of energy can be determined by simple tests.

For example, in a case of an embodiment of a full-jacket helix-type centrifuge for thickening a sludge at the ratio of 1:10 with an inflow capacity of 300 m3/h and a removal of solids of 30 m3/h, a nozzle design for 200 m3/h as well as a diversion of 70 m3/h is recommended for regulating the level by way of the throttle disk 31.

When lower capacities of, for example, 200 m3/h inflow are implemented, a quantities of solids of, for example, 20 m3/h is obtained. In the case of this quantity, a nozzle design for 110 m3/h as well as a diversion of 70 m3/h would be recommended for regulating the level by way of the throttle disk 31.

For an adaptation to different capacities, the nozzles 21 are simply exchanged for those of a different diameter. A high-expenditure exchange of expensive and complicated components is not required.

The nozzles 21 may be arranged in a plane perpendicular to the drum axis S at a distance from an outer drum radius or circumference of from 25 to 75% of the drum radius. That is because a gain of energy is larger the closer the nozzles 21 are to the drum circumference. However, an arrangement farther toward an interior may be more favorable when the diameter of the nozzles 21 or their opening cross-section are larger than in the case of an arrangement farther toward the outside, so that they clog less rapidly. The above-mentioned range represents a compromise.

As in German Patent Document DE 43 20 265 A1, a change of the discharge cross-section by adjusting the distance between the throttle disk 31 and the outlet 29 causes a change of the fluid level FS in the drum 3. In this case, the fluid level FS in the full-jacket helix-type centrifuge is precisely adjusted by the throttle disk 31.

The following applies in the case of the full-jacket helix-type centrifuge of FIG. 2 to a discharging particle flow $Q_w$ by way of the weir 15 with a diameter $d_w$, a circumferential speed $U_w$ at the weir diameter $d_w$ amounting to:

$$P(Q_w)=p\times Q_w\times U^2_w.$$

In contrast, in the case of the centrifuge of the present disclosure, the largest portion of the volume flow at the diameter $d_w$ is diverted through the nozzles (volume flow $Q_D$), and another partial flow is diverted through the outlet 29 of throttle disk 31.

If, as a result of the throttle disk 31, the fluid level FS in the chamber 33 is held at the weir diameter $d_w$, the capacity as a result of the throughput fraction $Q_D$ flowing off from the nozzles 21 amounts to:

$$P(Q_D)=p\times Q_D\times U^2_w\times A.$$

In the case of a nozzle inclination angle between 0 and 30°, a clear power demand reduction is computed from this formula. Distance A is a function of the diameter $d_w$ and of a shape of the cross-section of the nozzle 21, of the level FS in the drum and of an emission angle of the nozzle 21. The geometry of the cross-sections of the nozzles 21 may have an arbitrary design; thus, it may be round or square or of a different shape.

Figure 3:
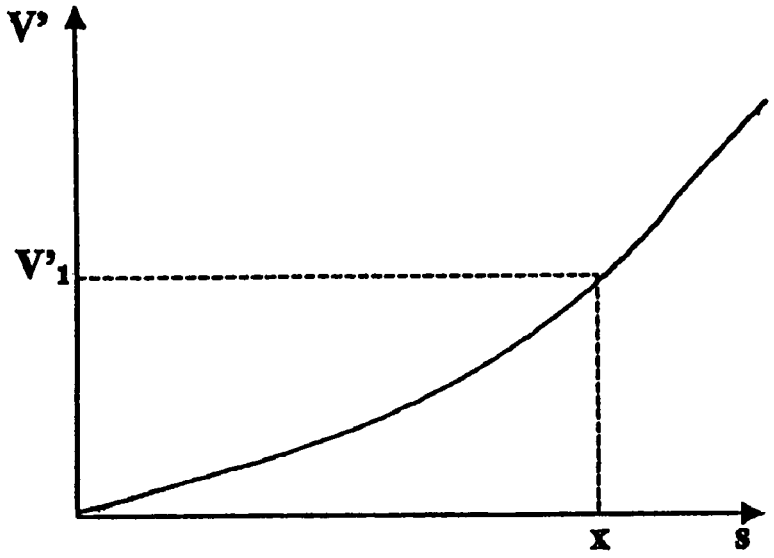
Fig. 3 PRIOR ART
FIG. 3 is a graph illustrating effects of a prior art centrifuge.

FIG. 3 shows the effects of a centrifuge of the type according to German Patent Document DE 43 20 265 A1, without nozzles. A gap width s, between the throttle disk 31 and the drum weir port 17, is entered on the X-axis; a volume flow V' is entered on the Y-axis. For a gap width x, a volume flow V'1 is thereby obtained. The larger the gap width s, the larger the volume flow which is diverted between the throttle disk 31 and the drum weir 17 out of the drum 3. Inversely, the larger the volume flow becomes, the narrower the gap width s between the throttle disk 31 and the drum weir is. Simultaneously, the pool depth or fluid level FS rises within the decanter drum 3; that is, the surface level of the liquid moves further toward the interior as the gap s decreases.

Figure 4:
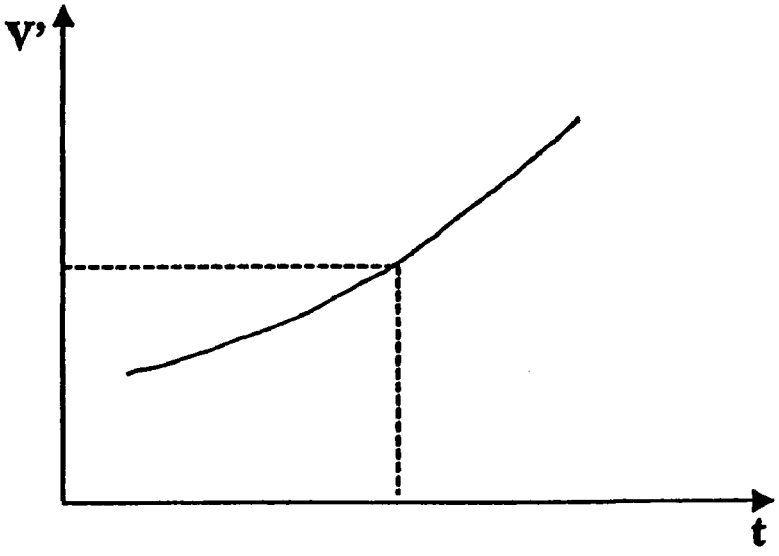
FIG. 4 is a graph illustrating the effects of a centrifuge, according to the present disclosure.

In contrast, FIG. 4 shows the effects of the volume flow V' at the nozzles 21 of a centrifuge of the present disclosure. Here, the volume flow V' rises with an increasing pool depth or fluid level FS as a result of pressure at the nozzle inflow present in the fluid. Both effects are mutually superimposed. In practice, this increases a control range of the decanter of the type of FIG. 1 to twice the amount of the decanter without nozzles 21 of the type of FIG. 3.

Although the present disclosure has been described and illustrated in detail, it is to be clearly understood that this is done by way of illustration and example only and is not to be taken by way of limitation. The scope of the present invention is to be limited only by the terms of the appended claims.

The invention claimed is:

1. A full-jacket helix-type centrifuge, comprising:

a drum including a drum axis and an outer drum radius;

at least one weir having a port;

a throttle disk adjacent to the port, the throttle disk being located at a variable distance from the port;

a first outlet adjacent to the throttle disk for discharging clarified liquid from the drum;

at least one nozzle rotating with the drum, the at least one nozzle being adjacent to the port and having a nozzle outlet for discharging clarified liquid from the drum, the nozzle outlet being independent of the first outlet; and wherein, in a plane perpendicular to the drum axis, the at least one nozzle is located at a distance from the outer drum radius, the distance being 25 to 75% of the outer drum radius.

2. The full-jacket helix-type centrifuge according to claim 1, wherein the at least one nozzle has a diameter of more than two millimeters.

3. The full-jacket helix-type centrifuge according to claim 1, wherein the at least one nozzle is connected behind the port and the throttle disk is connected behind the at least one nozzle.

4. The full-jacket helix-type centrifuge according to claim 1, wherein the at least one nozzle is configured to be changeable.

5. The full-jacket helix-type centrifuge according to claim 4, wherein the at least one nozzle is configured to include a screwing body.

6. The full-jacket helix-type centrifuge according to claim 5, wherein the at least one screwing body is screwed into at least one opening of a ring attachment at a lid of the drum.

7. The full-jacket helix-type centrifuge according to claim 1, wherein the at least one nozzle includes a plurality of nozzles distributed on a drum lid of the drum.

8. The full-jacket helix-type centrifuge according to claim 7, wherein the plurality of nozzles are configured to include screwing bodies, and the screwing bodies are screwed into openings of a ring attachment at the lid of the drum.

9. The full-jacket helix-type centrifuge according to claim 1, wherein the at least one nozzle is arranged in a nozzle chamber formed by a ring attachment, and an inside diameter of the nozzle chamber corresponds to an outside diameter of the port.

10. The full-jacket helix-type centrifuge according to claim 9, wherein inlet openings of the at least one nozzle are arranged flush with the inside diameter of the nozzle chamber.

11. The full-jacket helix-type centrifuge according to claim 1, wherein an inlet opening of the at least one nozzle is arranged flush with an inside diameter of a nozzle chamber formed by a ring attachment.

12. The full-jacket helix-type centrifuge according to claim 1, wherein an inlet opening of the at least one nozzle is aligned at an angle with respect to an axis of rotation of the drum.

13. The full-jacket helix-type centrifuge according to claim 1, wherein an opening of the at least one nozzle is directed backwards relative to a rotating direction of the drum.

14. The full-jacket helix-type centrifuge according to claim 1, wherein an inlet opening of the at least one nozzle, relative to a tangent to a drum surface in a plane perpendicular to an axis of rotation of the drum, has an inclination of between zero and 30°.

15. The full-jacket helix-type centrifuge according to claim 1, wherein, relative to an outer wall of the drum, an opening of the at least one nozzle is directed radially toward an outside of the drum.

16. The full-jacket helix-type centrifuge according to claim 1, further including a ring attachment including an outlet at its end facing away from the port, and the throttle disk being located at an output side of the outlet.

17. The full-jacket helix-type centrifuge according to claim 1, wherein a distance between the throttle disk and an outlet is variable by displacing the throttle disk along an axis substantially parallel to the drum axis.

18. The full-jacket helix-type centrifuge according to claim 1, wherein a circumferential speed of the drum at an outer diameter of the drum during an operation is more than 70 m/s.

19. The full-jacket helix-type centrifuge according to claim 1, wherein the throttle disk is constructed so as to stand still relative to the drum during an operation of the centrifuge.

20. The full-jacket helix-type centrifuge according to claim 1, wherein the throttle disk is constructed so as to rotate along with the drum during an operation of the centrifuge.

21. The full-jacket helix-type centrifuge according to claim 1, wherein the at least one nozzle includes a plurality of nozzles distributed on a component attached to a drum lid.

* * * * *